United States Patent [19]

Engman

[11] Patent Number: 4,538,857

[45] Date of Patent: Sep. 3, 1985

[54] FOOT REST ARRANGEMENT FOR WHEELCHAIRS

[75] Inventor: Bo H. S. Engman, Sunds Bruk, Sweden

[73] Assignee: Permobil AB, Timra, Sweden

[21] Appl. No.: 491,015

[22] Filed: May 3, 1983

[30] Foreign Application Priority Data

May 4, 1982 [SE] Sweden ..... 8202780

[51] Int. Cl.[3] ..... A47C 7/50

[52] U.S. Cl. ..... 297/437; 297/436

[58] Field of Search ..... 297/429, 433, 436, 437

[56] References Cited

U.S. PATENT DOCUMENTS

| | | | |
|---|---|---|---|
| 516,493 | 3/1894 | Knight | 297/436 |
| 1,225,811 | 5/1917 | Hasty | 297/437 |
| 2,767,774 | 10/1956 | Derby | 297/436 |
| 2,904,102 | 9/1959 | Komori | 297/437 |
| 4,076,304 | 2/1978 | Deucher | 297/437 |
| 4,229,039 | 10/1980 | Day | 297/437 |
| 4,408,801 | 10/1983 | Edel et al. | 297/433 |

FOREIGN PATENT DOCUMENTS

| | | | |
|---|---|---|---|
| 2709960 | 9/1978 | Fed. Rep. of Germany | 297/429 |

*Primary Examiner*—William E. Lyddane
*Assistant Examiner*—Joseph Falk
*Attorney, Agent, or Firm*—James & Franklin

[57] ABSTRACT

A foot rest arrangement for wheelchairs includes a telescopic strut structure with an outer (B) and an inner strut (C) axially displaceable inside the outer strut, and a foot rest (A) attached to the free lower end (at 0) of one strut (B) while the opposing free upper end of the other strut (C) is attached to the wheelchair frame or to the forward portion of the chair seat frame, so that the strut structure carries the foot rest at a distance from the chair seat (6), this distance being variable by raising and lowering the foot rest and/or chair seat. Latching means (H,R) are also arranged to lock the struts relative each other, with the foot rest at a given distance from the chair seat.

A suitable illustration is FIG. 1.

7 Claims, 6 Drawing Figures

FOOT REST ARRANGEMENT FOR WHEELCHAIRS

Figure 1:
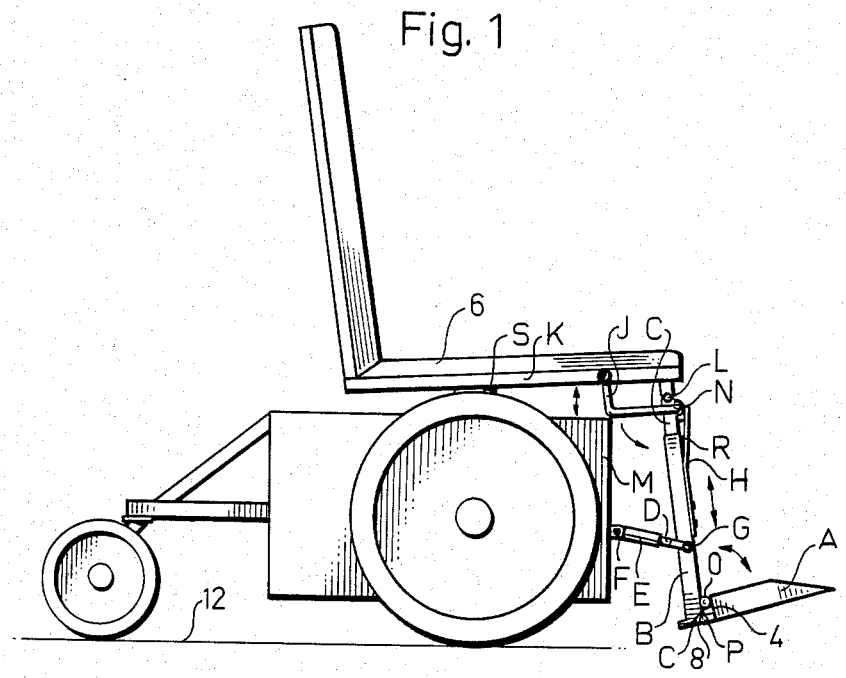

The present invention relates to a foot rest arrangement for wheelchairs.

Wheelchairs have either a foot rest common to both feet or two foot rests, one for each foot, normally carried at a given distance from the seat of the stool with the aid of a fixed frame structure. When the user of the wheelchair wishes to move from the chair or sit in it, the foot rest or foot rests must either be swung to one side so that the user can place his feet on the ground or floor in front of the chair, or this person must move obliquely out of or into the chair. This makes these movements complicated and difficult to perform for the handicapped person.

The object of the present invention is to remove this drawback associated with already known structures and to facilitate getting into and getting out of the wheelchair for the handicapped person.

This object is achieved by a foot rest arrangement for wheelchairs, characterized in that a foot rest is attached to the free lower end of the exterior member in a strut structure comprising an outer strut and an inner strut axially displaceable in it, the free, upper end of inner strut being attached to the wheelchair frame or to the forward portion of the chair seat frame so that the strut structure carries the foot rest at a distance from the chair seat, this distance being variable by raising or lowering the foot rest and/or the chair seat, releasable latching means being adapted to lock the struts relative each other with the foot rest at an appropriate distance from the chair seat.

By thus providing an arrangement in which the distance between the seat and the foot rest may be varied, there is enabled lowering the foot rest into engagement with the floor or ground when a handicapped person is to move out of the chair, for example, and then with the foot rest in this position raising the chair seat until the handicapped person assumes a nearly upright attitude. There is thus only a very slight change from this attitude to a standing attitude, and the handicapped person can easily move from the foot rest to the surrounding substructure (floor or ground).

In an advantageous embodiment of the invention, the foot rest is formed with an upstanding back edge, on the upper portion of which the foot rest is pivotably mounted at the outer strut. Furthermore, the lengths of the struts are so adjusted that in the latched position thereof the lower end of the inner strut projects out from the bottom end of the outer strut, to bear with a bevelled edge against a glide roller adapted at the lower portion of the back edge of the foot rest to lock the foot rest, in an angular position comfortable for the user, in said latched position of the struts. When the foot rest is then lowered towards the floor or ground and/or the chair seat is raised, the bevelled edge will no longer engage against the glide roller, so that the foot rest can pivot to adjust itself to the substructure.

In accordance with a further advantageous embodiment of the arrangement in accordance with the invention, the outer and inner struts have holes in their walls, these walls being in register when the position intended for latching is assumed, so that a spring biased latching pin can be thrust into the holes for latching the struts when the wheelchair is to travel.

The foot rest arrangement in accordance with the invention can be used in principle on any type of wheelchair at all. It can thus be used to advantage on a six-wheeled wheelchair of the type described in the Swedish patent application No. 8202763-2.

Figure 2:
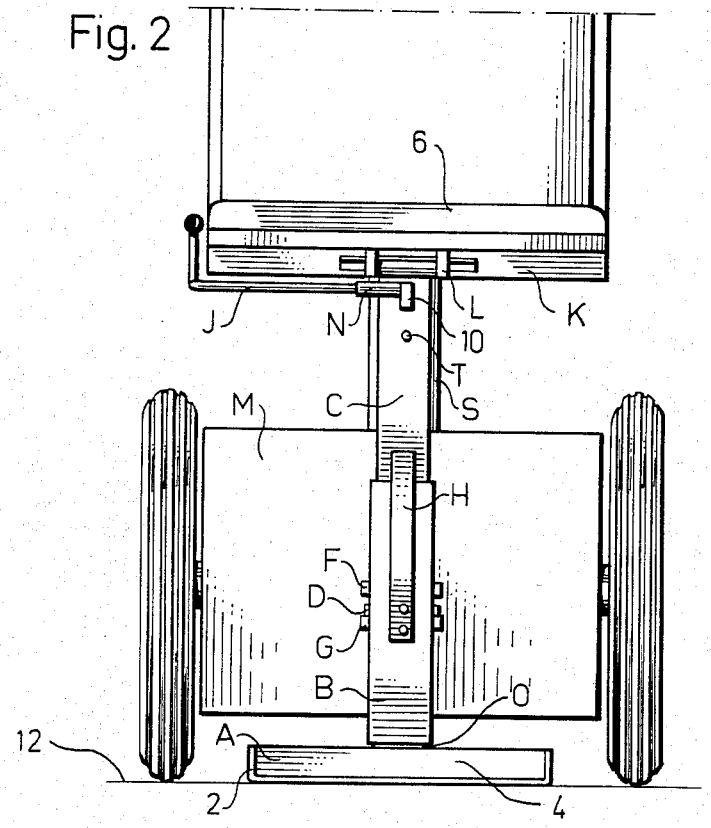

An embodiment of the arrangement in accordance with the invention applied to a four-wheeled type of wheelchair selected as an example, will be described in detail in the following with reference to the accompanying drawings, in which FIG. 1 is a side view of one embodiment of the arrangement in accordance with the invention applied to a four-wheeled wheelchair, FIG. 2 is a view seen from the front of the embodiment according to FIG. 1 FIGS. 3–6 schematically illustrate the inventive arrangement in different functional positions to illustrate its operation.

A wheelchair of the four-wheeled type is illustrated in FIG. 1. At the forward portion of the seat frame K there is attached a telescopic strut structure for carrying a foot rest A.

The strut structure comprises an inner strut C axially displaceable inside an outer strut B. The upper end of the inner strut C is pivotably mounted at a connection L to the seat frame K, while the foot rest A is pivotably attached to the lower portion of the outer strut B.

The foot rest is formed with two upstanding side edges 2, see FIG. 2, and an upstanding back edge 4. The foot rest A is attached to the outer strut B at a pivot connection O at the upper portion of the back edge 4.

The lengths of the struts B and C are adjusted such that the lower end of the inner strut C projects out from the bottom end of the outer strut B when the struts are in a mutually latched position, as will be described more closely below. The lower end of the inner strut C is formed with a bevel 8 which, in the latched position, will bear against a glide roller P disposed at the lower portion of the back edge 4 of the foot rest A. The foot rest A will accordingly be locked in a somewhat upwardly sloping position, comfortable for the handicapped person when using the wheelchair, see FIG. 1.

Releasable latching means are adapted for latching the outer and inner struts B,C, to each other. The front faces of the outer and inner struts C are thus formed with holes T, see FIG. 2, which are in register for the intended latching position of the struts B, C, so that a latching pin R can be inserted in the holes for this purpose. The latching pin R is attached to a leaf spring H, the downward end of which is attached to the forward face of the outer strut B such that the latching pin R is spring biased into said holes as soon as they are in register.

An operating means is adapted for releasing the latching of struts B, C, when the strut structure is to be extended to lower the foot rest A and/or to raise the chair seat 6. The operating means comprises a latching lever J pivotable about an axis N arranged above the upper end of the leaf spring H. The lever J is further formed with a downwardly projecting portion 10, at least the tip of which comes under the upper portion of the leaf spring H in the latched position of the strut. To release the latch, the lever J is turned anti-clockwise about the axis N, the handle portion of the lever being moved downwards, which causes the tip of the portion 10 to engage and lift the spring H with the pin R out of the holes. The latch between the two struts B and C is thus removed and the strut structure may be extended, i.e. the distance between foot rest and chair seat may be increased.

At its lower portion the outer strut B is connected to the wheelchair frame M via a telescopic linkage device. The linkage device comprises an inner link D, pivotably attached to the outer strut B at a pivot connection G, and an outer link E which is pivotably attached to the wheelchair frame via a connection F. The links D and E may be fixed relative each other in optional positions, to adjust the attitude of the strut structure and thereby the foot rest A in a suitable position.

Figure 3:
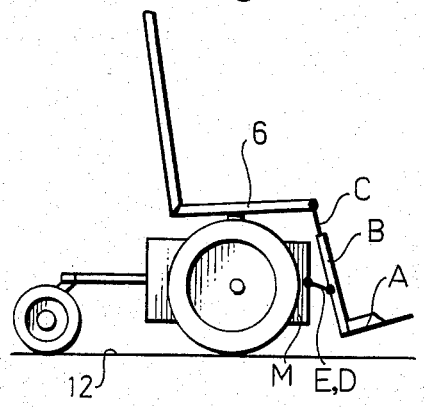
Figure 4:
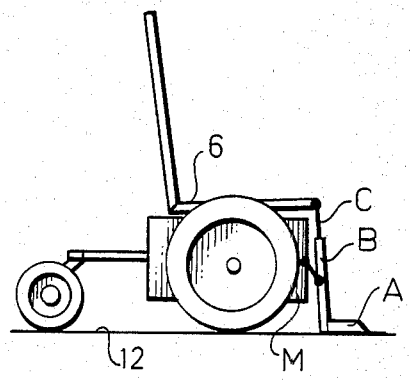
Figure 5:
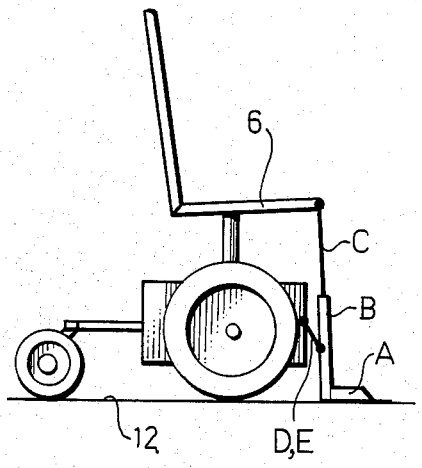

The function of the foot rest arrangement is schematically illustrated in FIGS. 3–5. FIG. 3 accordingly illustrates a wheelchair with the chair seat and foot rest arrangement in the normal travelling position of the wheelchair. The struts B and C are in their latched positions here. When the handicapped person is to move out of the wheelchair, the chair and the foot rest arrangement are lowered with unaltered mutual positions until the foot rest A bears against the substructure 12. This position is illustrated in FIG. 4. In the next phase, the latch on the struts B and C is released and the chair seat 6 is raised, as illustrated in FIG. 5, the inner strut C being drawn out of the outer strut B. The bevel 8 on the lower end of the inner strut C will no longer bear against the glide roller P, and the foot rest A can turn about the connection O to suit the substructure 12, see also FIG. 1. The chair seat 6 can be raised until the handicapped person assumes an almost standing attitude, so that very little effort is required to assume a standing attitude, and since the foot rest A nestles against the substructure 12, movement of the handicapped person from the footrest A to the substructure 12 is facilitated as much as possible. When a person is to be seated in the wheelchair, the operations illustrated by FIGS. 3–5 are carried out in reverse order.

Instead of the method of operation as described in FIGS. 3–5, locking the struts B and C may alternatively be performed with the chair seat 6 in the position illustrated in FIG. 3, so that the foot rest A can be lowered to the substructure 12 by extending the strut structure B, C with the chair seat 6 retained at an unaltered height, subsequent to which the chair seat is raised as illustrated in FIG. 5. However, the series of operations described first is generally more smoothly carried out, and is therefore to be preferred. In releasing the lock on the struts B, C with the wheelchair in the position illustrated in FIG. 3, the foot rest A can fall freely to the substructure 12 and knock against it with some force.

It is also possible to provide special lifting means for the foot rest, which automatically lift the foot rest to its normal travelling position as soon as the chair seat 6 reaches the normal travelling position, shown in FIG. 3, after being lowered from the raised position in FIG. 5.

Figure 6:
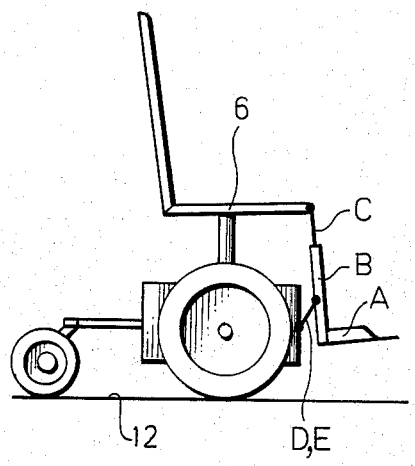

Finally, in FIG. 6 there is illustrated the possibility of using the wheelchair with the chair seat 6 in a raised position and with the struts B, C in the locked position intended to be assumed when the wheelchair is in use, the foot rest A being also locked at the desired angle.

A special driving means is adapted to raising the chair seat, as indicated at S in FIG. 1. This driving means S suitably consists of a purely mechanical raising and lowering mechanism driven by an electric motor.

I claim:

1. A foot rest arrangement for wheelchairs comprising:

(A) a frame system including
  (i) a wheelchair frame, and
  (ii) a chair seat frame supported by said wheelchair frame and mounting a chair seat;

(B) a foot rest formed with an upstanding back edge and a glide roller at the back edge of the lower portion of said foot rest;

(C) a strut structure comprising an outer strut and an inner strut operatively interconnected and mutually displaceable in an axial direction, the upper portion of said upstanding back edge of said foot rest being pivotably attached to the lower end portion of said outer strut and the upper end portion of said inner strut being secured to said frame system so that said strut structure carries said foot rest at a distance from said chair seat;

(D) releasable latching means operatively engageable with said inner and outer struts and adapted to lock said inner and outer struts in a latched position relative to each other with said foot rest at an appropriate distance from said chair seat; and (E) means operatively connected to said latching means for permitting varying the distance between said foot rest and said chair seat by raising or lowering one relative to the other; the lengths of said struts being selected such that in the latched position of said struts the lower end portion of said inner strut defines a bevelled edge projecting out from said lower end portion of said outer strut to bear against said glide roller, thereby by abutment of said bevelled edge and said glide roller to lock said foot rest in a given angular position relative to said strut structure when the struts are in the latched position.

2. Arrangement as claimed in claim 1, characterized in that the outer and inner struts have apertures in their walls which are in register when the position intended for latching is obtained, and in that a spring-biased latching pin is arranged to pass into the apertures in this position, for latching the struts to each other.

3. Arrangement as claimed in claim 2, characterized in that the latching pin is attached to a leaf spring arranged on the outside of the outer strut.

4. Arrangement as claimed in claim 2 or 3, characterized in that operating means are disposed for moving the latching pin out of the apertures against spring bias, to release the latch on the struts.

5. Arrangement as claimed in claim 1, characterized in that the inner strut is pivotably mounted to the chair seat frame, and in that telescopic links, which are mutually lockable in different positions of extension are pivotably adapted between the outer strut and the chair seat frame to keep the strut structure in the desired position.

6. Arrangement as claimed in claim 1 characterized in that the upper end portion of the inner strut is secured to a forward portion of the chair seat frame.

7. Arrangement as claimed in claim 1 characterized in that the inner strut is axially telescopically displaceable within the outer strut.

* * * * *